US007341526B2

(12) United States Patent
McCarthy

(10) Patent No.: US 7,341,526 B2
(45) Date of Patent: Mar. 11, 2008

(54) GOLF PUTTER HAVING ALIGNMENT AID FOR ALIGNING A GOLFER'S HEAD IN AT LEAST FOUR AXES

(76) Inventor: Robert McCarthy, 40 Maple Ave., Box 0, Unadilla, NY (US) 13849

( * ) Notice: Subject to any disclaimer, the term of this patent is extended or adjusted under 35 U.S.C. 154(b) by 252 days.

(21) Appl. No.: 11/103,248

(22) Filed: Apr. 11, 2005

(65) Prior Publication Data

US 2006/0229137 A1 Oct. 12, 2006

(51) Int. Cl.
*A63B 69/36* (2006.01)

(52) U.S. Cl. ..... 473/251; 473/254

(58) Field of Classification Search ..... 473/219–256; D21/736–746

See application file for complete search history.

(56) References Cited

U.S. PATENT DOCUMENTS

D228,563 S * 10/1973 Brower ..... D21/744
3,880,430 A * 4/1975 McCabe ..... 473/253
4,136,877 A * 1/1979 Antonious ..... 473/254
4,343,472 A * 8/1982 Hamilton ..... 473/240
4,458,900 A * 7/1984 Antonious ..... 473/254
4,508,350 A * 4/1985 Duclos ..... 473/254
4,986,544 A * 1/1991 Benson ..... 473/254
5,248,145 A * 9/1993 Brown ..... 473/254
5,538,249 A * 7/1996 Benson ..... 473/254
5,676,603 A * 10/1997 Miller ..... 473/220
5,921,868 A * 7/1999 DiMartino ..... 473/254
6,062,986 A * 5/2000 Kaise ..... 473/242
6,394,910 B1 * 5/2002 McCarthy ..... 473/251

* cited by examiner

*Primary Examiner*—Sebastiano Passaniti
(74) *Attorney, Agent, or Firm*—Mark Levy & Associates, PLLC

(57) ABSTRACT

A golf putter having an alignment aid for aligning the player's head relative to the ball and the putter head. In addition to providing alignment along the usual X and Y axes, the alignment aid of the invention allows precise and repeatable head positioning in the fourth and fifth axes as well. A pair of vertically-aligned pins protrude from a back surface of the putter head, substantially perpendicular to the putting face of the club. The diameter of the upper pin is less than the diameter of the lower pin. In addition, the length of the upper pin may be slightly shorter that the length of the lower pin. Typically, the pins are made in contrasting colors such as black and white. In operation, a golfer sights down at the pins and establishes a uniform border of the lower pin visible around the upper pin.

16 Claims, 5 Drawing Sheets

GOLF PUTTER HAVING ALIGNMENT AID FOR ALIGNING A GOLFER'S HEAD IN AT LEAST FOUR AXES

RELATED APPLICATIONS

This application is related to U.S. Pat. No. 6,394,910 for GOLD PUTTER FOR ALIGNING A PLAYER'S HEAD which is included herein by reference in its entirety.

FIELD OF THE INVENTION

The present invention relates to golf putters and, more particularly, to an alignment aid for a golf putter that helps a golfer align his or her head along four axes.

BACKGROUND OF THE INVENTION

Putting is a difficult task at best, and sometimes almost an impossible feat. Every golfer has experienced those days when the ball just does not fall into the cup. It is at these moments that most golfers would wish to have additional help. The fact is, however, that the motion of a golf ball is controlled by Newton's three laws of motion. Thus a controlled swing of a golf club results in the desired speed and direction of the ball.

Every golfer has his favorite putter, which is used to guide the ball into the hole. Putters come in many sizes and shapes to accommodate the individual tastes and preferences of the sports enthusiast.

Golfers usually concentrate upon or at least take into account the break and speed of the green when putting. Their attention is focused mainly upon the trajectory or path that the ball is to travel to the cup. The golf club head must strike the ball at a 90° angle to the intended direction of travel thereof. Some golf putters have a line or groove drawn along the center of the top of the club head, in order to provide an indicator that will align the club face with the ball, and point to the direction of the cup. Although this can be a useful visual aid, such golf club markings are often prohibited by rules of golf associations, such as the United States Golf Association (USGA).

It has long been known that a golfer's head must be aligned with his or her club face to ensure proper direction of the struck ball. Lines, grooves, or other similar devices provide the golfer help in aligning his or her head in the X and Y axes. Such alignment aids have been found to improve a golfer's putting accuracy. However, it has also been found the alignment in the fourth and fifth axes provide further improvement in a golfer's putting accuracy. Fourth, fifth, and sixth axes are defined as rotation axes around the well-known X, Y, and Z-axes of the Cartesian coordinate system, respectively. These definitions are especially well known to people skilled in the CAD and the machining arts.

Allowing a golfer to repeatably position his or her head in relation to the ball and the putter is greatly beneficial to an improved golf score, especially in the putting portion of the game.

SUMMARY OF THE INVENTION

In accordance with the present invention, there is provided an alignment aid for a golf putter that allows a player to align his or her head relative to the ball and the putter head, typically directly above the ball. This over-the-ball alignment is in addition to alignment along the usual X and Y axes, provided by prior art alignment aids. While alignment in the X and Y axes is indeed useful in improving the accuracy of a putt, it is not enough. It has been found that if, in addition to proper alignment in the X and Y axes, the golfer properly aligns his or her head in the fourth and fifth axes, further improvement in putting accuracy may be obtained. The alignment aid of the invention provides precise and repeatable head positioning along the fourth and fifth axes. With improved repeatability and precision in head placement, a golfer's putting game is typically improved.

A pair of vertically-aligned pins protrude from a back surface of the putter head, substantially perpendicular to the putting face of the club. The diameter of the upper pin is slightly less than the diameter of the lower pin. In addition, the upper pin is slightly shorter that the lower pin. Typically, the pins are made in contrasting colors; for example the upper pin may be black while the lower pin may be white.

In operation, as a golfer looks down at the putter, the upper pin hides all but a portion of the lower pin. As the golfer moves his or her head, a position will be found wherein the border of color of the lower pin visible around the upper pin is uniform. This condition is achieved in only a single, precise location of the golfer's head. Consequently, when the golfer aligns his head to achieve the uniform border of visibility, his head will be precisely in the same position with respect to the putter each and every time. The pins may be adjusted to allow calibration to a particular putter head or to the particular needs of an individual golfer.

It is, therefore, an object of the invention to provide an alignment aid for a golf putter.

It is another object of the invention to provide an alignment aid for a golf putter having visual means by which a golfer can align his head relative to the putter head in a fourth and fifth axes as well as along an X and a Y axis.

It is an additional object of the invention to provide an alignment aid for a golf putter wherein a golfer's head may be precisely and repeatably aligned relative to the putter head.

It is a further object of the invention to provide an alignment aid for a golf putter having a pair of vertically aligned pins projecting rearwardly from the putter head.

It is yet another object of the invention to provide an alignment aid for a golf putter wherein the pins have differing diameters.

It is a still further object of the invention to provide an alignment aid for a golf putter wherein the alignment pins have differing lengths.

It is an additional object of this invention to provide an alignment aid for a golf putter wherein the pins have contrasting colors.

It is a further object of the invention to provide an alignment aid for a golf putter that is accepted by golf association rules.

BRIEF DESCRIPTION OF THE DRAWINGS

A complete understanding of the present invention may be obtained by reference to the accompanying drawings, when considered in conjunction with the subsequent detailed description, in which.

DETAILED DESCRIPTION OF THE PREFERRED EMBODIMENT

Generally speaking, the invention features an alignment aid for a golf putter for helping a golfer to align his or her head consistently with the putter and the ball, typically directly over the ball. It has been shown that when such alignment is consistently achieved, a golfer's putting game is improved.

Figure 1:
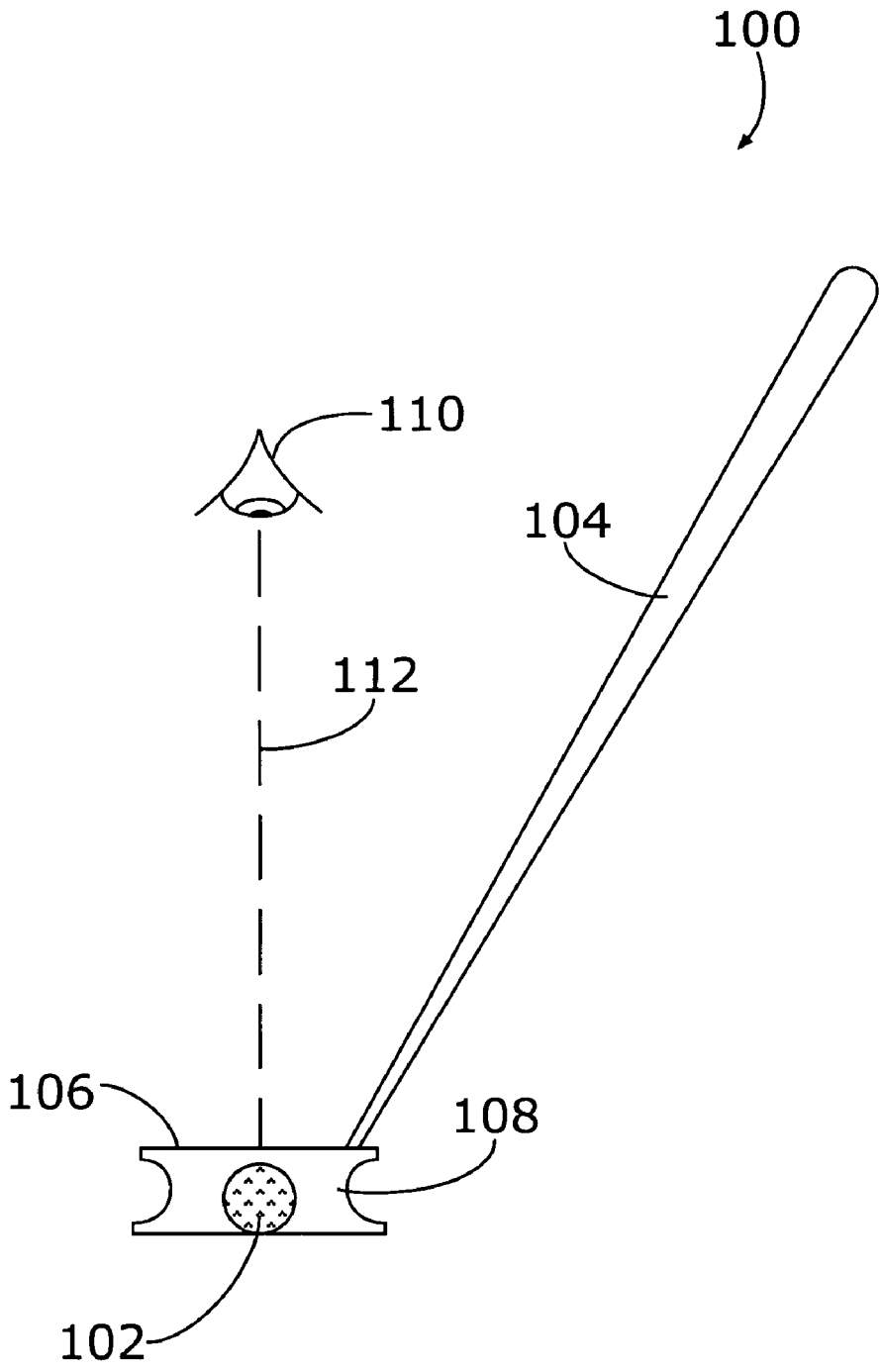
FIG. 1 is a front elevational schematic view of a putter aligned with a golf ball.

Referring first to FIG. 1, there is shown a front elevational view of a golf putter 100 aligned with a golf ball 102. Putter 100 has a handle 104 adapted for gripping by a golfer, not shown. Handle 104 is attached to a putter head 106 having a putting face 108 adapted for striking a golf ball 102. A golfer's eye 110 looks down at putter head 106 and ball 102 along a sightline 112.

Figure 2A:
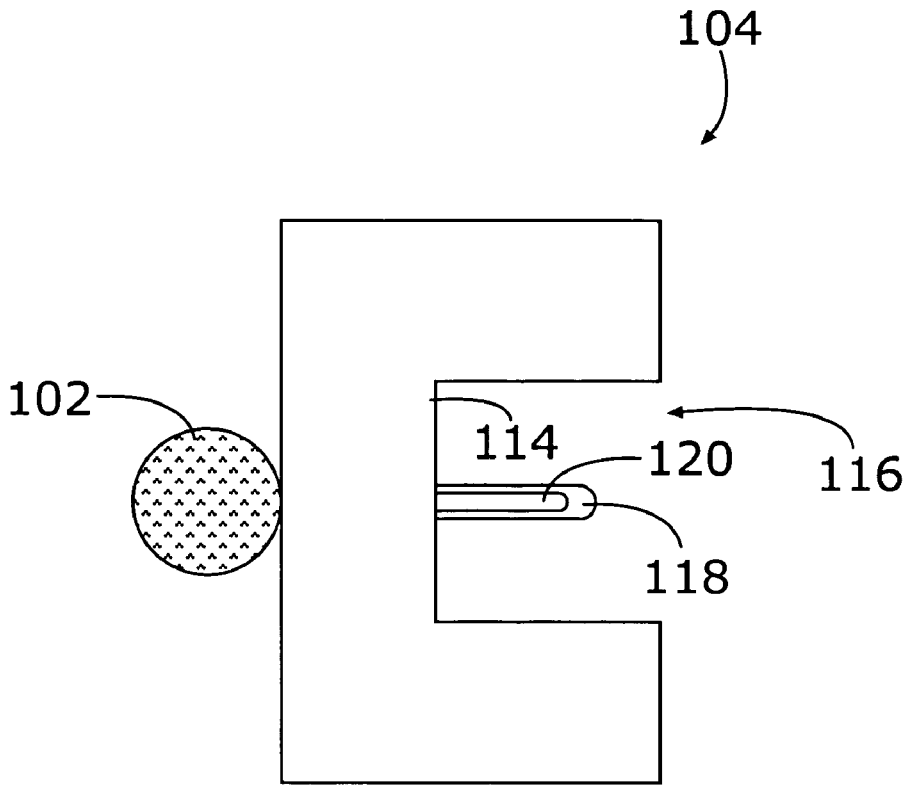
FIGS. 2*a* and 2*b* are top plan and rear elevational views, respectively, of the putter head showing the alignment aid of the invention.
Figure 2B:
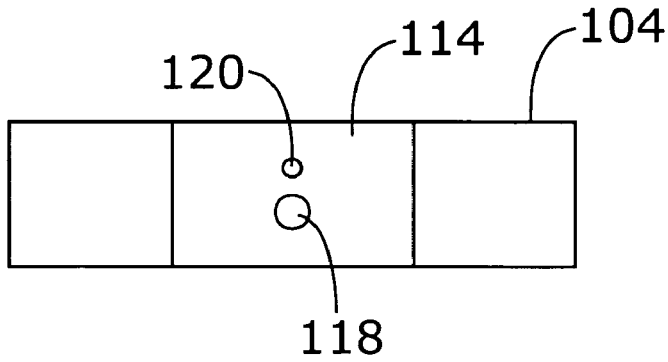

Referring now to FIGS. 2*a* and 2*b*, there are shown detailed top plan and rear elevational views, respectively, of putter head 104 incorporating the alignment aid of the invention. Putter head 104, when viewed from the top as shown in FIG. 2*a*, is U-shaped. A central rear surface 114 is substantially parallel to putting face 108 and defines a forward boundary of cutaway region 116. A lower alignment pin 118 is disposed in central rear surface 114 and projects rearwardly therefrom into cutaway region 116. An upper alignment pin 120 is disposed above lower alignment pin 118 and also projects rearwardly from central rear surface 114 into cutaway region 116.

Lower alignment pin 118 has a first diameter larger than a second diameter of upper alignment pin 120. Also, as may readily be seen in FIG. 2*a*, lower alignment pin 118 is typically longer than upper alignment pin 120, thereby projecting further from central rear surface 114 into cutaway region 116. In addition, lower alignment pin 118 is a light color, preferably white, while upper alignment pin 120 is a dark color, typically black. It will be recognized that lower alignment pin 118 and upper alignment pin 120 could be the same or a similar color. However, optimally a contrast in color between lower alignment pin 118 and upper alignment pin 120 is desirable. It has been found that when lower alignment pin 118 is a lighter color than upper alignment pin 120, the visibility of the pins in their intended method of operation is optimized.

The exact positions of lower alignment pin 118 and upper alignment pin 120 on central rear face depends upon the geometry of putter head 104 and, to some extent, to the exact needs or preferences of a particular golfer. Regardless of the exact positions of lower alignment pin 118 and upper alignment pin 120, their relative positions are established such that when a golfer with his or her head directly over the ball sights down sightline 112, the view of the alignment pins 118, 120 is as shown in FIG. 2*a*.

Figure 4A:
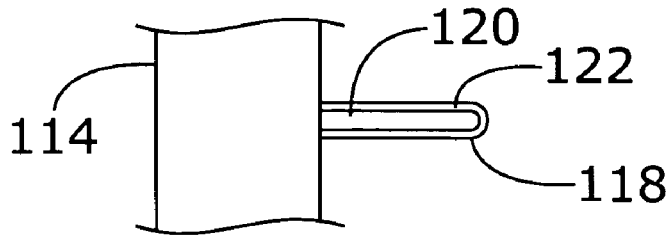
FIGS. 4*a*-4*c* are schematic, top views of the alignment aid of the invention as viewed by a golfer showing proper head alignment and two cases of misalignment of the golfer's head in the fifth axis.

Referring now to FIGS. 4*a*-4*f*, there are shown several views of lower alignment pin 118 and upper alignment pin 120 as viewed by a golfer, not shown, along sightline 112 (FIG. 1) under both proper and improper head alignment conditions. When a golfer's head is properly aligned with respect to putter head 104 and ball 102, alignment pins 118, 120 appear as shown schematically in FIG. 4*a*. In FIG. 4*a*, a uniform band of white (or other light color associated with lower alignment pin 118) 122 is visible.

Figure 3:
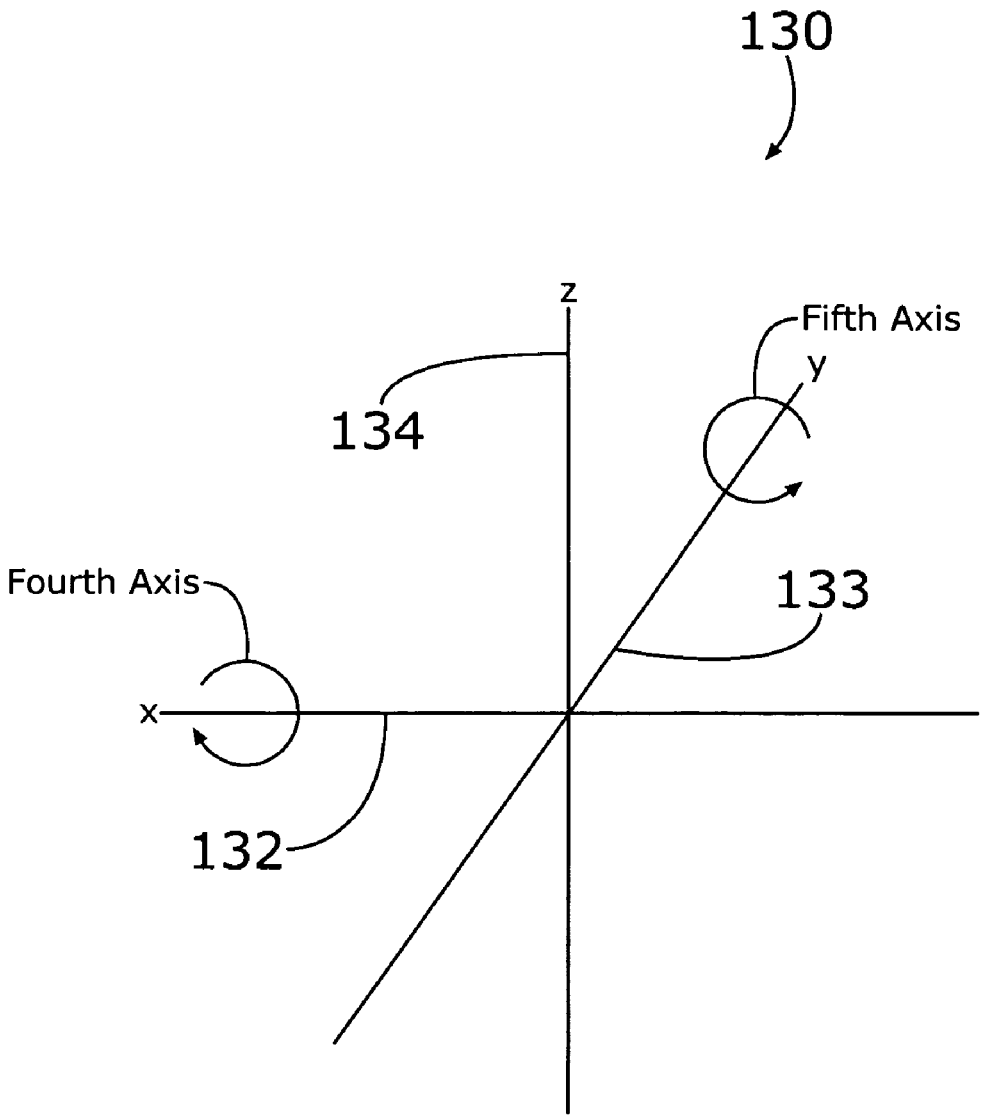
FIG. 3 is a schematic representation of a Cartesian coordinate system having six axes identified.

Referring now also to FIG. 3, there is shown a schematic representation of a Cartesian coordinate system, generally at reference number 130. Three mutually orthogonal axes (X-axis 132, Y-axis 134, and Z-axis 136) are well known. It is useful to define three additional axes, namely the fourth, fifth, and sixth axes which are defined as rotation axes around respectively, the X, Y, and Z-axes. These terms are well known in the fields of CAD and three-dimensional machining where they are useful in defining motions of, for example, a cutting head in a numerically controlled machine. The fourth and fifth axes are also useful to describe the motion of a golfer's head relative to the putter head 104 and ball 102.

If the axis parallel to putting face 108 is defined as the X-axis, then as a golfer moves his or her head around the X-axis particularly by tilting the head forward or backward, the motion may be labeled as movement along the fourth axis. Likewise, if the Y-axis is defined as that axis perpendicular to putting face 108, a golfer's side-to-side head tilting movements may be referred to as movement along the fifth axis.

Figure 4B:
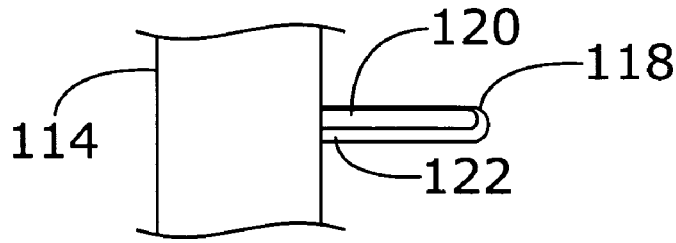
Figure 4C:
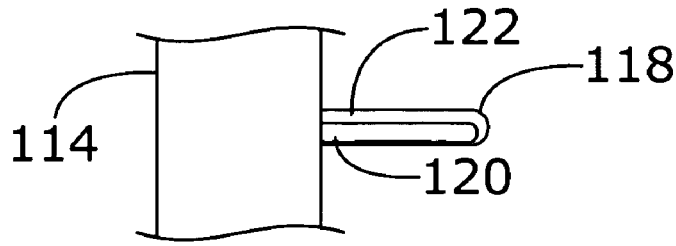

Heretofore, no alignment aid has been available to allow a golfer to accurately and repeatably position his or her head in an optimal spot directly over the ball 102. Using the alignment aid of the invention, as a golfer moves his or her head along the fourth axis, his view of alignment pins 118, 120 will be as shown in FIGS. 4*b* and 4*c*. In FIG. 4*b*, the golfer's head is too far back, in FIG. 4*c*, the golfer's head is too far forward. In extreme cases, no light-colored band 122 may be visible on one or the other side of upper locating pin 120.

Figure 4D:
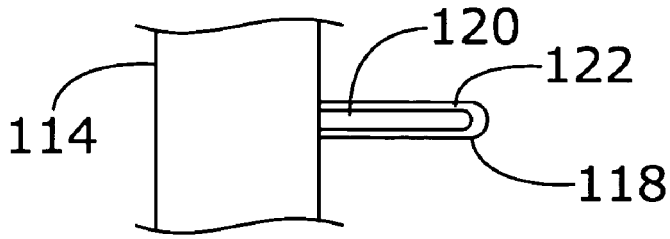
FIGS. 4*d*-4*f* are schematic, top views of the alignment aid of the invention as view by a golfer showing three cases of misalignment of the golfer's head in the fourth axis.
Figure 4E:
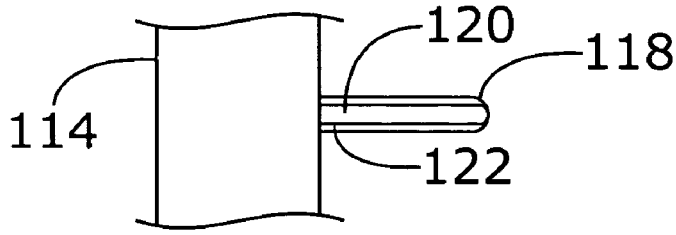
Figure 4F:
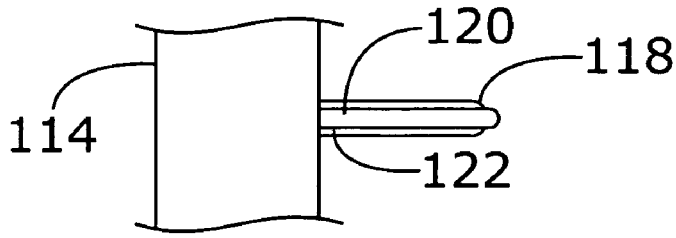

Likewise, as a golfer moves his or her head along the fifth axis, the view of alignment pins 118, 120 will vary as may be seen in FIGS. 4*d*-4*f*.

Once the positions of the alignment pins 118, 120 have been established, the golfer may quickly and repeatedly place his or her head in exactly the same spot directly over the ball 102. This head placement repeatability has been found to significantly improve putting accuracy.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A golf putter having an alignment aid, comprising:

a) a putter head having a putting face for addressing and striking a golf ball and an opposing rear face substantially parallel to said putting face;

b) a lower alignment pin having a circular cross-section, a first diameter, and a first length disposed on said opposing rear face and projecting rearwardly therefrom; and c) an upper alignment pin having a substantially circular cross-section, a second diameter, and a second length disposed on said opposing rear face and projecting rearwardly therefrom and above said lower alignment pin, said lower alignment pin being parallel to said upper alignment pin, a center of said upper alignment pin being vertically aligned with a center of said lower alignment pin, whereby alignment of the head of a user of said golf putter may be aligned along a fourth and a fifth axis.

2. The golf putter having an alignment aid as recited in claim 1, wherein said first length and said second length are substantially equal.

3. The golf putter having an alignment aid as recited in claim 1, wherein said first length and said second length are unequal.

4. The golf putter having an alignment aid as recited in claim 1, wherein at least one of said first length and said second length may be changed.

5. The golf putter having an alignment aid as recited in claim 1, wherein said lower alignment pin and said upper alignment pin have contrasting colors.

6. The golf putter having an alignment aid as recited in claim 5, wherein said lower alignment pin has a lighter color than said upper alignment pin.

7. The golf putter having an alignment aid as recited in claim 1, wherein said lower alignment pin is white and said upper alignment pin is black.

8. The golf putter having an alignment aid as recited in claim 1, wherein said lower alignment pin and said upper alignment pin are disposed in a cutaway portion of said putter head.

9. A method of using a golf putter, the steps comprising:

a) providing a golf putter having a putter head comprising an alignment aid comprising a pair of alignment pins disposed thereupon, each of said pair of alignment pins having a circular cross section; and b) using said pair of alignment pins to position a head of a user relative to at least said putter head, said pair of alignment pins comprising a lower alignment pin having a first diameter and an upper alignment pin having a second diameter different from said first diameter, both said lower alignment pin and said upper alignment pin being disposed on and projecting rearwardly from a rear face of said putter head, said lower alignment pin being parallel to, and directly below, said upper alignment pin, said arrangement of said alignment pins being provided to assist a golfer in aligning the golf putter along at least one of a fourth and a fifth axis.

10. The method of using a golf putter as recited in claim 9, wherein said using step (b) comprises sighting along a sightline toward said upper alignment pin and said lower alignment pin and positioning said golfer's head such that a uniform border of said lower alignment pin is visible around said upper alignment pin.

11. The method of using a golf putter as recited in claim 9, wherein said lower alignment pin and said upper alignment pin have contrasting colors.

12. The method of using a golf putter as recited in claim 9, wherein said lower alignment pin has a lighter color than said upper alignment pin.

13. The method of using a golf putter as recited in claim 9, wherein said lower alignment pin is white and said upper alignment pin is black.

14. The method of using a golf putter as recited in claim 9, wherein said using step (b) is accomplished by said golfer moving his or her head along at least one of a fourth and a fifth dimension.

15. A golf putter having an alignment aid, comprising: a putter head having a putting face for addressing and striking a golf ball, a rear face substantially parallel to said putting face, a lower alignment pin having a first diameter and a first color, and an upper alignment pin disposed above said lower alignment pin and having a second smaller diameter and a second color, both said upper and said lower alignment pins having circular cross sections and being disposed parallel to one another on said rear face and projecting rearwardly therefrom, the arrangement of said alignment pins facilitating a golfer in aligning the golf putter along at least one of a fourth and a fifth axis.

16. The golf putter having an alignment aid as recited in claim 15, wherein said first color is lighter than said second color.

* * * * *